US005802831A

United States Patent [19]

Imamura

[11] Patent Number: 5,802,831

[45] Date of Patent: Sep. 8, 1998

[54] PIECING METHOD FOR A SPINNING MACHINE

[75] Inventor: Yuji Imamura, Kyoto, Japan

[73] Assignee: Murata Kikai Kabushiki Kaisha, Kyoto, Japan

[21] Appl. No.: 856,171

[22] Filed: May 14, 1997

[30] Foreign Application Priority Data

May 16, 1996 [JP] Japan ..... 8-146638
May 16, 1996 [JP] Japan ..... 8-146641

[51] Int. Cl.[6] ..... D01H 11/00

[52] U.S. Cl. ..... 57/261; 57/279; 57/328; 57/333

[58] Field of Search ..... 57/261, 279, 328, 57/333, 22, 23, 287

[56] References Cited

U.S. PATENT DOCUMENTS 5,067,315 11/1991 Stahlecker ..... 57/333
5,419,110 5/1995 Mikami et al. ..... 57/328
5,511,373 4/1996 Banba ..... 57/261
5,673,547 10/1997 Baba et al. ..... 57/261

FOREIGN PATENT DOCUMENTS 6-173130 6/1994 Japan ..... 57/328
6-287819 10/1994 Japan .

*Primary Examiner*—William Stryjewski
*Attorney, Agent, or Firm*—Armstrong, Westerman, Hattori, McLeland & Naughton

[57] ABSTRACT

On a piecing method of a spinning machine which, after cutting a sliver between normally rotating draft rollers and stationary draft rollers, inserts a leading yarn into the spindle of a twist device and carries out piecing by the restarting of the draft rollers, restarting of the twist device and running of the leading yarn, approximately all the fibers comprising the tapered tip of the cut sliver form the joint part by being entangled in the leading yarn. As almost all of the fibers comprising the tapered tip of the cut sliver contribute to the joint part, the success rate of piecing is increased and a stronger joint part may be formed.

7 Claims, 12 Drawing Sheets

PIECING METHOD FOR A SPINNING MACHINE

FIELD OF THE INVENTION

The present invention relates to a piecing method of a spinning machine for joining cut yarn.

BACKGROUND OF THE INVENTION

A piecing method is known whereby the winding side yarn end is guided into a twist device of a spinning machine and thereafter, the end of the sliver is guided into the twist device and the yarn end of the yarn of the winding side (being the yarn drawn from the yarn package and hereafter, known simply as "leading yarn") guided into the twist device are joined by a spinning process due to the restarting of spinning.

Using FIG. 4 and FIG. 5 being side views including a partial section of one example of a spinning machine having a twist device, FIG. 6A being a plan view showing the tapered cut tip of the sliver, FIG. 6B being a plan view showing the state where that tip is drawn and FIG. 7 being a plan view of a conventional yarn piecing part of a leading yarn and the sliver tip in the drawn state, the problem which the present invention attempts to resolve will be described.

Reference D is a draft device showing a four line type draft device as an example. The draft device D comprises the four lines including back rollers 1, third rollers 2, middle rollers 3 attached with an apron belt and front rollers 4. Reference 5 is a condenser positioned between the third rollers 2 and middle rollers 3. The sliver supplied to the draft device D produces yarn Y by being supplied to the twist device (described later) after being drawn by the draft device D.

A twist device T comprises mainly an air spinning nozzle 6 which produces a spinning air current, nozzle block 7 which supports the spinning nozzle, spindle (yarn guide tube) 8 having an insertion hole 8*b* and of which the tip 8*a* is positioned in the inner part 6*a* of the air spinning nozzle 6, and a spindle support member 9 that supports that. The inner part 6*a* of the air spinning nozzle 6 is the piecing area where joining of the fibers comprising the sliver S supplied to the inner part 6*a* of the air spinning nozzle 6 and the leading yarn Y' inserted into the insertion hole 8*b* of the spindle 8 and guided into the inner part 6*a* of the air spinning nozzle 6 is carried out.

A plurality of air blowing holes 6*b* for generating a rotating air current are arranged in the air spinning nozzle 6. Reference 10 is an air chamber formed between the nozzle block 7 and spindle support member 9. The air chamber 10 is connected to an air suction source (not shown in the drawings) that sucks air at a low suction pressure via the suction hole 11 and during spinning, acts as an escape hole for the air blown from the air blowing holes 6*b* of the air spinning nozzle 6 as well as removing fly fiber waste, and the like, generated inside the air chamber 10 during spinning.

Reference 12 is a slit formed in the side wall of the nozzle block 7 side spindle support member 9. Reference 13 is a slit formed in the side wall of the spindle support member 9 side nozzle block 7 opposite the slit 12 of the spindle support member 9. As described later, when the nozzle block 7 and spindle support member 9 are coupled together, the leading yarn Y' inserted in the insertion hole 8*b* of the spindle 8 exits the tip 8*a* and, enters the slits 12, 13 and the arrangement is such that it is not trapped by the side wall of nozzle block 7 and the side wall of the spindle support member 9.

Reference 14 is a cylinder. A lower frame 16 of the spindle support member 9 is mounted on the tip of a piston rod 15 of the cylinder 14. Accordingly, the cylinder 14 is moved and the spindle support member 9 is able to couple with, or separate from, the nozzle block 7 by the left and right movements of the lower frame 16.

Reference 18 is a nip roller being freely connectable/separable to the delivery roller 19 which is normally always driven and is so arranged that the spun yarn Y is delivered in the direction of the winding machine (not shown in the drawings) by connecting the nip roller 18 with the delivery roller 19.

When the spinning machine is spinning yarn Y, the sliver S supplied to the draft device D is twisted by the twist device T after being drawn by the draft device D and forms yarn Y. In short, the fibers comprising the sliver S supplied to the air spinning nozzle 6 of the twist device T enter the insertion hole 8*b* of the spindle 8 from the tip 8*a* while being rotated by a rotating air current blown from the air blowing holes 6*b* and yarn Y is produced.

When a yarn breakage occurs, a detection signal is generated by a detection sensor (not shown in the drawings) and in association with that, supply of the sliver S is stopped by stoppage of the driving of the back rollers 1 and third rollers 2 via a clutch (not shown in the drawings) connected to the back rollers 1. The twist device T continues operations as before. The tip of the sliver Sa is then immediately pulled into a tapered shape between the stationary third rollers 2 and still driving middle rollers 3 as shown in FIG. 6A. Furthermore, after a predetermined time period has elapsed, the blowing of air from the air blowing holes 6*b* is stopped and the operation of the twist device T stopped. Further, the nip rollers 18 are separated from the delivery rollers 19.

Next, the piston rod 15 is advanced by movement of the cylinder 14, the spindle support member 9 is separated from the nozzle block 7 and the tip of the leading yarn Y' wound onto the winding package is pulled from the winding package by a publicly known suction mouth or, alternatively the leading yarn Y' is wound off from another package and inserted in the insertion hole 8*b* of the spindle 8 and pulled through tip 8*a*.

Next, the piston rod 15 is retracted by operation of the cylinder 14 and the spindle support member 9 and nozzle block 7 are coupled. Even if the spindle support member 9 and nozzle block 7 couple, the leading yarn Y' is not trapped by the walls of the spindle support member 9 and nozzle block 7 as it enters the slits 12, 13. A predetermined length of leading yarn Y' inserted in the slits 12, 13 is held by suction by being inserted in the suction member 17.

Afterwards, the rotation of the stationary back rollers 1 and third rollers 2 is restarted and the sliver S gripped in the back rollers 1 and third rollers 2 and of which the tip Sa is positioned between the third rollers 2 and middle rollers 3 moves. Immediately after the restarting of the back rollers 1 and third rollers 2, the leading yarn Y' is ran by the nip rollers 18 contacting the delivery rollers 19 and the twist device T operated, in short, air is blown from the air blowing holes 6*b*. Thus, the fibers comprising the sliver S delivered from the front rollers 4 are guided into the guide entrance 6*c* of the air spinning nozzle 6 and is pieced by entangling with the leading yarn Y' which has started running in the vicinity of the tip 8*a* of the spindle 8.

However, when the stationary back rollers 1 and third rollers 2 are restarted, the tip Sa of the tapered sliver S as shown in FIG. 6A pulled out between the third rollers 2 and middle rollers 3 moves in the direction of the middle rollers 3, and is drawn by the middle rollers 3 and front rollers 4 and becomes the long thin needle shaped part Sb as shown in FIG. 6B. For example, if the draft ratio of the third rollers 2 and middle rollers 3 is 40–50 times and the length of the tip Sa of the tapered sliver S pulled out between the third rollers 2 and middle rollers 3 is 10 mm, the length of the long thin needle shaped part Sb drawn by the middle rollers 3 and front rollers 4 will become 400–500 mm.

Furthermore, as the length of the leading yarn Y' inserted in the insertion hole 8*b* of the spindle 8 and held in the suction member 17 from the tip 8*a* of the spindle 8 is normally approximately 200 mm, the state of the yarn pieced part is, as shown in FIG. 7, with only the tip part Sb' of the long thin needle shaped part Sb wrapped around the leading yarn Y'. Accordingly, the tip part Sb' of the long thin needle shaped part Sb wrapped around the leading yarn Y' becomes slipped out from the leading yarn Y', yarn breakage is caused once again or yarn breakage re-occurs in weak places of the long thin needle shaped part Sb which is not wrapped around the leading yarn Y'.

SUMMARY OF THE INVENTION

In order to solve the problems present in a conventional piecing method of a spinning machine, it is an aim of the present invention to propose a piecing method of a spinning machine capable of forming a joint with good thickness and shape.

In order to achieve the above mentioned aim, on a piecing method of a spinning machine which, after cutting a sliver between normally rotating draft rollers and stationary draft rollers, inserts a leading yarn into the spindle of a twist device and carries out piecing by the restarting of the draft rollers, restarting of the twist device and running of the leading yarn, a first aspect of the present invention is where approximately all the fibers comprising the tapered tip of the cut sliver forms the joint part by being entangled in the leading yarn.

A second aspect is where, while the leading yarn is stationary, the fibers comprising the tapered tip of the cut sliver is contacted with the leading yarn and then running of the leading yarn is started.

A third aspect of the present invention is where the fibers comprising the tapered tip of the cut sliver are contacted with the running leading yarn.

DETAILED DESCRIPTION OF THE PREFERRED EMBODIMENTS

Figure 1:
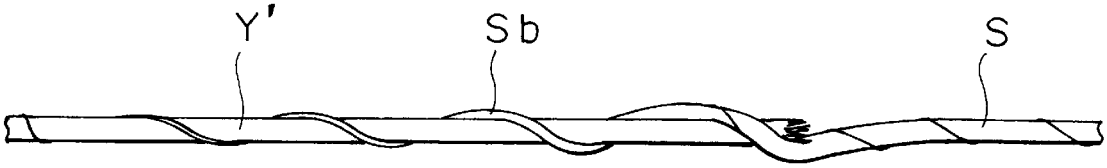
FIG. 1 is a plan view of the joint part formed by the method of the present invention.
Figure 2:
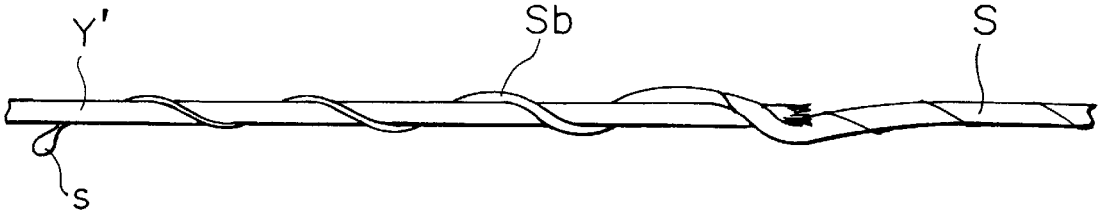
FIG. 2 is a plan view of another joint part formed by the method of the present invention.
Figure 3:
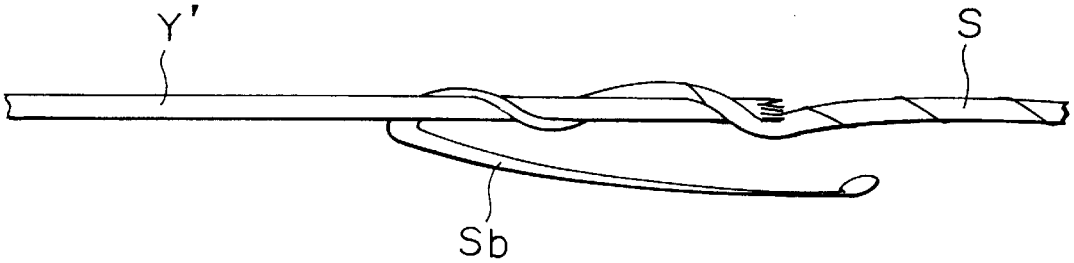
FIG. 3 is a plan view of yet another joint part formed by the method of the present invention.
Figure 4:
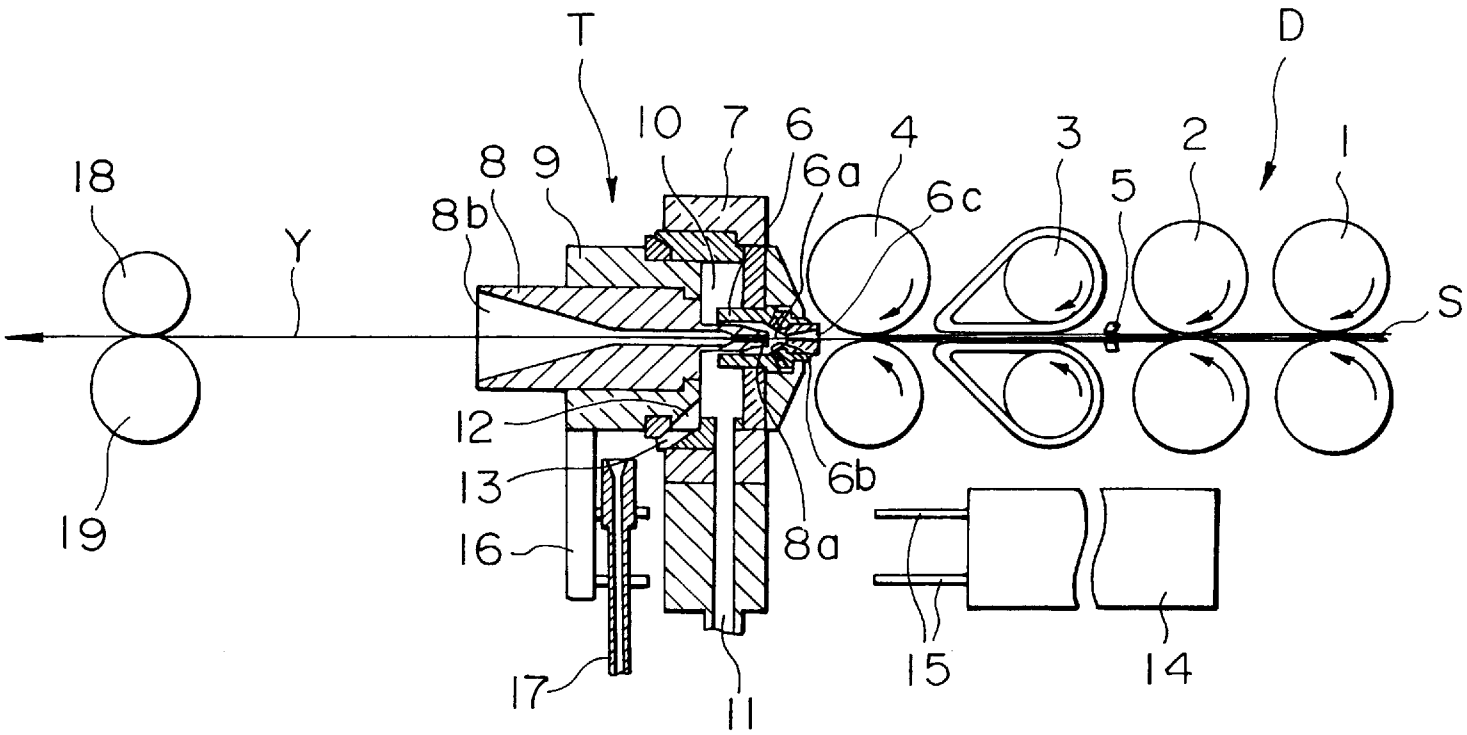
FIG. 4 is a side view including a partial section of one example of the spinning machine having a twist device.
Figure 5:
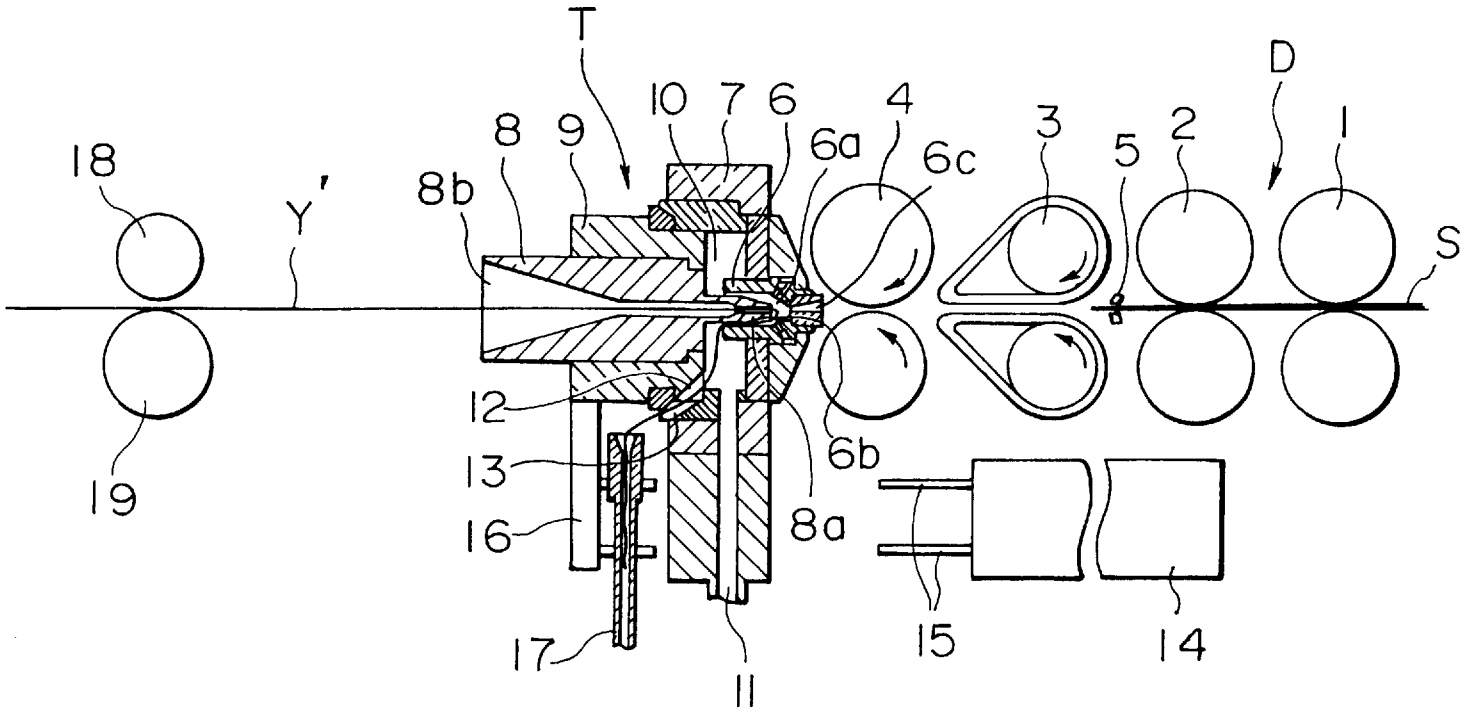
FIG. 5 is similarly a side view including a partial section of one example of the spinning machine having a twist device.

Below, using FIGS. 1–3 being plan views of the joint part formed by the method of the present invention, a first embodiment of the present invention will be described.

As explained above, when piecing is carried out, the leading yarn Y' is inserted in the insertion hole 8*b* of the spindle 8, pulled out from that tip 8*a* and suction held by being inserted in the suction member 17 via the slits 12, 13 of the coupled spindle support member 9 and nozzle block 7. Thereafter, the driving of the stationary back rollers 1 and third rollers 2 is restarted and immediately after that, the leading yarn Y' is run by the contacting of the nip roller 18 with the delivery roller 19, the fibers comprising the sliver S supplied to the internal part 6*a* of the air spinning nozzle 6 are entangled with the leading yarn Y' by the operation of the twist device T and piecing is carried out.

Figure 6A:
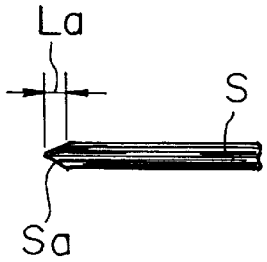
FIG. 6A is a plan view showing the tapered cut tip of the sliver and FIG. 6B is a plan view showing the state where that tip is drawn.
Figure 6B:
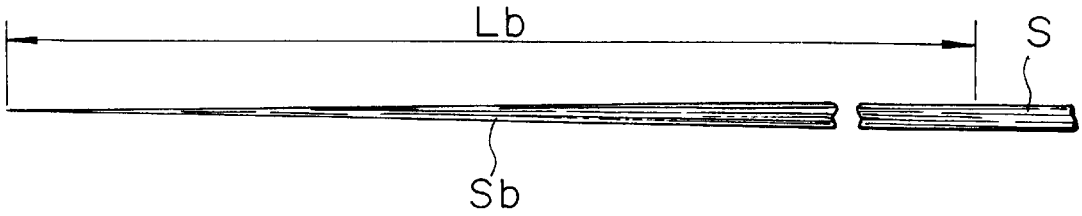

Incidentally, when a yarn breakage occurs, the back rollers 1 and third rollers 2 stop and the tip Sa of the sliver S is pulled out into a tapered shape as shown in FIG. 6A between the stationary third rollers 2 and still rotating middle rollers 3. However, the length of this tapered tip Sa will have an approximately uniform length if the operating conditions of the used sliver and spinning machine are the same. Furthermore, this tip Sa is drawn by the middle rollers 3 and front rollers 4 and forms a long thin needle shaped part Sb as shown in FIG. 6B but this length (Lb) is the product of multiplying the length (La) of the aforementioned tapered tip Sa with the draft ratio (R) between the middle rollers 3 and front roller 4, i.e. $Lb=La\times R$.

Further, when piecing is to be carried out, the leading yarn Y' is run by contacting the nip roller 18 with the delivery roller 19 and almost simultaneous with this the twist device T is re-operated. A predetermined time period before the start of running of the leading yarn Y' by the nip rollers 18 and delivery rollers 19, the rotation of the stationary back rollers 1 and third rollers 2 is restarted. This predetermined time period is the time (t) until the fibers which have been cut and which comprise the tapered tip Sa of the sliver S positioned between the third roller 2 and middle roller 3 are drawn by the middle roller 3 and front roller 4 and reach the tip 8*a* of the spindle 8.

Accordingly, the length (Ly) from the tip 8*a* of the spindle 8 where the entangling of the fibers comprising the tapered tip Sa of the sliver S with the leading yarn Y' to the tip of the leading yarn Y', which is suction held in the suction member 17, is approximately the same length as the product of multiplying the length (La) of the above tapered tip Sa with the draft ratio of the middle rollers 3 and front rollers 4, in short is approximately the same as length Lb=La×R of the long thin needle shaped part Sb.

Figure 7:
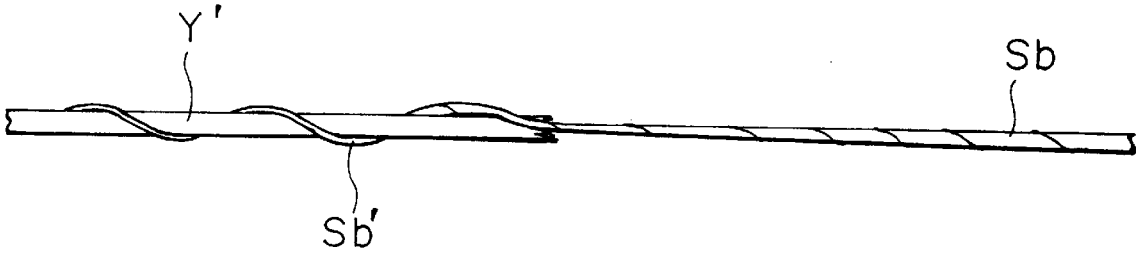
FIG. 7 is a plan view of a conventional joint part of a leading yarn and a sliver tip in the drawn state.

Furthermore, the fibers comprising the tapered tip Sa of the sliver S positioned between the third rollers 2 and middle rollers 3 are drawn by the middle rollers 3 and front rollers 4 for time (t) until they reach the tip 8*a* of the spindle 8 and, if the start of rotation of the back rollers 1 and third rollers 2 precedes the start of running of the leading yarn Y' due to the nip roller 18 and delivery roller 19, approximately the entire length of the long thin needle shaped part Sb drawn by the middle rollers 3 and front rollers 4 is wrapped around the leading yarn and there is no formation of thin weak parts in the spun yarn as shown in FIG. 7.

In the aforementioned embodiment, the fibers comprising the tapered tip Sa of the sliver S are positioned in the tip 8*a* of the spindle 8 at the point where the running of the leading yarn Y' starts due to contact between the nip roller 18 and delivery roller 19 and reaches the leading yarn Y' which is attempting to run. In short, the leading yarn Y' starts running at the point when the fibers comprising the tapered tip Sa of the sliver S reach the tip 8*a* of the spindle 8.

In order to more reliably entangle the fibers comprising the tapered tip Sa of the sliver S on the leading yarn Y' coming out of the tip 8*a* of the spindle 8, it is preferable for the running of the leading yarn Y' to be stopped for a predetermined time period at the point where the fibers comprising the tapered tip Sa of the sliver S reach the tip 8*a* of the spindle 8. Also, after the fibers comprising the tapered tip Sa of the sliver S have been entangled in the stationary leading yarn Y', the running of the leading yarn Y' is started by contact between the nip rollers 18 and delivery rollers 19. As the leading yarn Y' is stationary at the point when the fibers comprising the tapered tip Sa of the sliver S have reached the tip 8*a* of the spindle 8, the first part of the fibers comprising the aforementioned tip Sa collides with the leading yarn Y' and forms a knotted shaped part s. This knotted part s entangles with the leading yarn Y', as shown in FIG. 2, and forms a wrapping point of the subsequent fibers comprising the sliver S on the leading yarn Y' and piecing may be more reliably performed.

In the present embodiment, as the leading yarn Y' is stationary for a predetermined period of time, the length of this portion from the tip 8*a* of the spindle 8 to the tip of the leading yarn Y' held in the suction member 17 may be shortened less than the previously described length (La×R).

As described above, as the fibers comprising the tapered tip Sa of the sliver S are in contact with the stationary leading yarn Y', the fibers comprising the tapered tip Sa of the sliver S are able to more reliably entangle with the leading yarn Y' rather than contacting with the running leading yarn Y'. This embodiment is effective for when the used sliver S has little fuzziness or when the surface is slippery.

Furthermore, the leading yarn Y' may already be running at the point when the fibers comprising the tapered tip Sa of the sliver S are positioned at the tip 8*a* of the spindle 8. In this case, as the leading yarn Y' is already running, the fibers comprising the tapered tip Sa of the sliver S slip along the surface of the leading yarn Y' and do not entangle easily and the first part of the fibers comprising the tapered tip Sa of the sliver S are formed into a yarn shape by the rotating air current produced by the blown air from the air blowing holes 6*b* of the air spinning nozzle 6. Then, piecing is carried out by this yarn shaped part being wrapped around the running leading yarn Y', as shown in FIG. 3.

In the present embodiment, as the running of the leading yarn Y' has already started, the length from the tip 8*a* of the spindle 8 to the tip of the leading yarn Y' held in the suction member 17 is preferably longer than the aforementioned length Lb=La×R.

As a result of the structure as described above, the first embodiment of the present invention demonstrates the following advantages.

As almost all of the fibers comprising the tapered tip of the cut sliver contribute to the joint part, the success rate of the piecing increases and a stronger joint may be formed.

Next, a second embodiment of the present invention will be described using FIGS. 8 to 17.

In order to achieve the abovementioned aim, a first aspect of the present embodiment is piecing where, after cutting a sliver between normally rotating draft rollers and stationary draft rollers, a leading yarn is inserted into the spindle of a twist device, subsequently the stationary draft rollers are stopped after being rotated for a predetermined time period and thereafter, piecing is carried out by the restarting of the stationary draft rollers, restarting of the twist device and running of the leading yarn.

A second aspect is where, while the tip part of the leading yarn is inserted in the spindle of the twist device, the twist device is opened.

A third aspect of the present invention is the construction of a joint where, between the parts where fibers comprising the sliver are entangled, there exists parts where fibers are not entangled.

Hereafter a second embodiment of the present invention will be described using FIGS. 8–16 but, provided the aims of the present invention are not surpassed, the present invention is not limited to that described.

Figure 8:
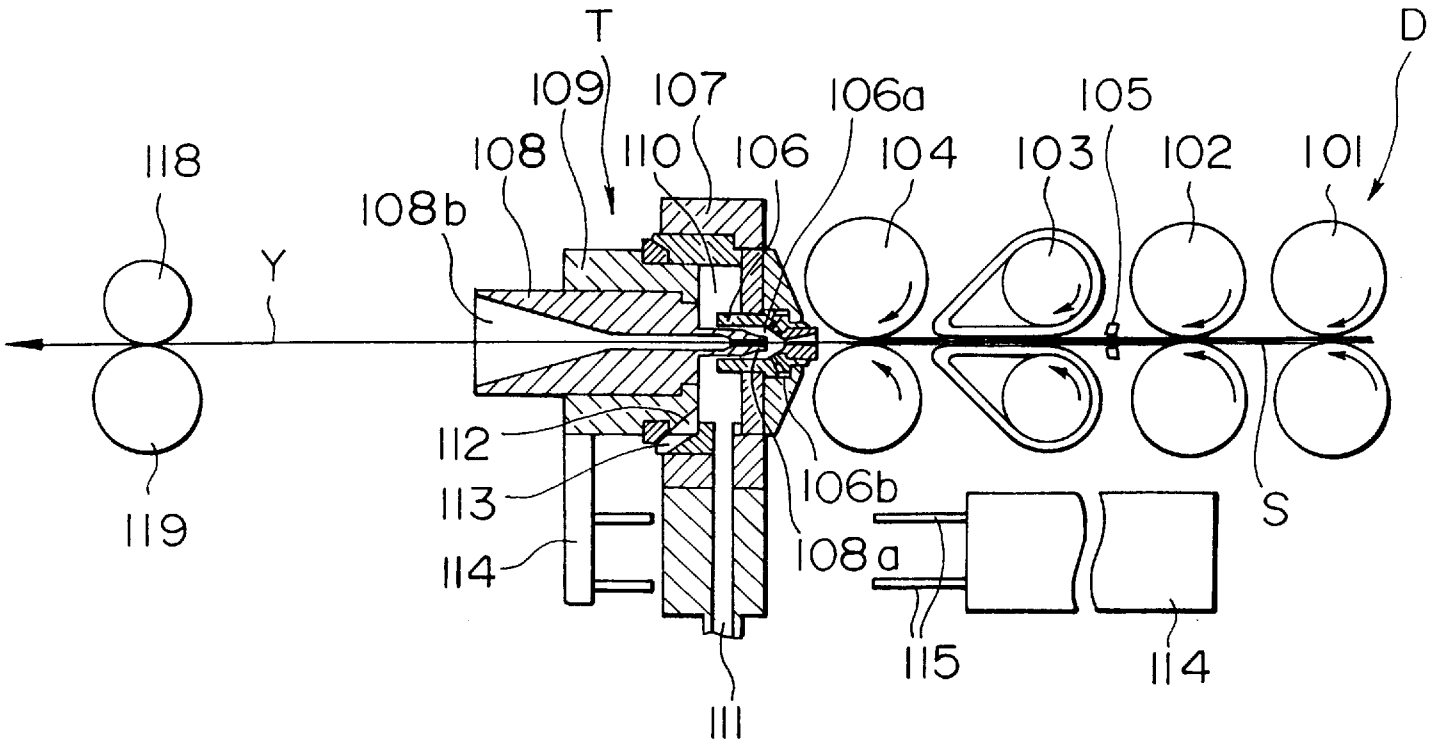
FIG. 8 is a side view including a partial sectional view of one example of a spinning machine applied to the present invention.

Firstly, the spinning machine to which the piecing method of the present embodiment is applied will be described using FIG. 8.

Reference D is a draft device showing a four line type draft device as an example. The draft device D comprises the four lines including back rollers 101, third rollers 102, middle rollers 103 attached with an apron belt and front rollers 104. Reference 105 is a condenser positioned between the third rollers 102 and middle rollers 103. The sliver S supplied to draft device D produces yarn Y by being supplied to the twist device T (described later) after being drawn by the draft device D.

The twist device T comprises mainly an air spinning nozzle 106 which produces a spinning air current from compressed air, nozzle block 107 which supports that, spindle (yarn guide tube) 108 having an insertion hole 108*b* and of which the tip 108*a* is positioned in the inner part 106*a* of the air spinning nozzle 106, and a spindle support member 109 that supports that. The inner part 106*a* of the air spinning nozzle 106 is the piecing area where joining of the fibers comprising the sliver S supplied to the inner part 106*a* of the air spinning nozzle 106 and the leading yarn Y' inserted into the insertion hole 108*b* of the spindle 108 and guided into the inner part 106*a* of the air spinning nozzle 106 is carried out.

A plurality of air blowing holes 106*b* for generating a rotating air current are arranged in the air spinning nozzle 106. Reference 110 is an air chamber formed between the nozzle block 107 and spindle support member 109. The air chamber 110 is connected to an air suction source (not shown in the drawings) that sucks air at a low suction pressure via the suction hole 111 and during spinning, acts as an escape hole for the air blown from the air blowing holes 106*b* of the air spinning nozzle 106, as well as removing fly fiber waste, and the like, generated inside the air chamber 110 during spinning.

Reference 112 is a slit formed in the side wall of the nozzle block 107 side spindle support member 109. Reference 113 is a slit formed in the side wall of the spindle support member 109 side nozzle block 107 opposite the slit 112 of the spindle support member 109. As described later, when the nozzle block 107 and spindle support member 109 are coupled together, the leading yarn Y' inserted in the insertion hole 108*b* the spindle 108 and of which exits the tip 108*a* exits, enters the slits 112, 113 and the arrangement is such that it is not trapped by the side wall of nozzle block 107 and the side wall of the spindle support member 109.

Reference 114 is a cylinder. A lower frame 116 of the spindle support member 109 is mounted on the tip of a piston rod 115 of the cylinder 114. Accordingly, the cylinder 114 is moved and the spindle support member 109 is able to couple with, or separate from, the nozzle block 107 by the left and right movements of the lower frame 116.

Reference 118 is a nip roller being freely connectable/separable to a delivery roller 119 which is normally always driven and is so arranged that the spun yarn Y is delivered in the direction of the winding machine (not shown in the drawings) by connecting the nip roller 118 with the delivery roller 119.

When the spinning machine is spinning yarn Y, the sliver S supplied to the draft device D is twisted by the twist device T after being drawn by the draft device D and forms a yarn Y. In short, the fibers comprising the sliver S supplied to the air spinning nozzle 106 of the twist device T enter the insertion hole 108*b* of the spindle 108 from the tip 108*a* while being rotated by a rotating air current blown from air blowing holes 106*b* and a yarn Y is produced. The produced yarn Y is delivered by the normally rotating delivery roller 119 with the nip roller 118 in contact with that delivery roller 119, and wound on a winding package (not shown in drawings).

When a yarn breakage occurs, a detection signal is generated by a detection sensor (not shown in the drawings) and in association with that, supply of the sliver S is stopped by stoppage of the driving of the back rollers 101 and third rollers 102 via a clutch (not shown in the drawings) connected to the back rollers 101. The twist device T continues operations as before. The tip of the sliver Sa is then immediately pulled into a tapered shape between the stationary third rollers 102 and still driving middle rollers 103 as shown in FIG. 6A.

Furthermore, after a predetermined time period has elapsed, the blowing of air from the air blowing holes 106*b* is stopped and the operation of the twist device T stopped. Further, the nip rollers 18 are separated from the delivery rollers 19.

Next, the piston rod 115 is advanced by movement of the cylinder 114, the spindle support member 109 separated from the nozzle block 107 and the head A' of transfer arm member A which grips by a pair of drive rollers a1, a2 the tip of the leading yarn Y' wound onto the winding package and pulled from the winding package by a publicly known suction mouth or the leading yarn Y' pulled from a package prepared for other uses, is positioned in the vicinity of the yarn exit hole 108*c* of the spindle 108. Conversely, a head part V' of an air sucker member V is positioned between the spindle support member 109 and nozzle block 107 such that it is in the vicinity of the tip 108*a* of the spindle 108. Thereafter, the leading yarn Y' is inserted in the insertion hole 108*b* of the spindle 108 by a suction operation of the head part V' and the drive rollers a1, a2 of the transfer arm member A and if neccessary, an opening operation of the leading yarn Y' by the head part V' as described later is performed (Refer to FIGS. 9 and 10).

Figure 11:
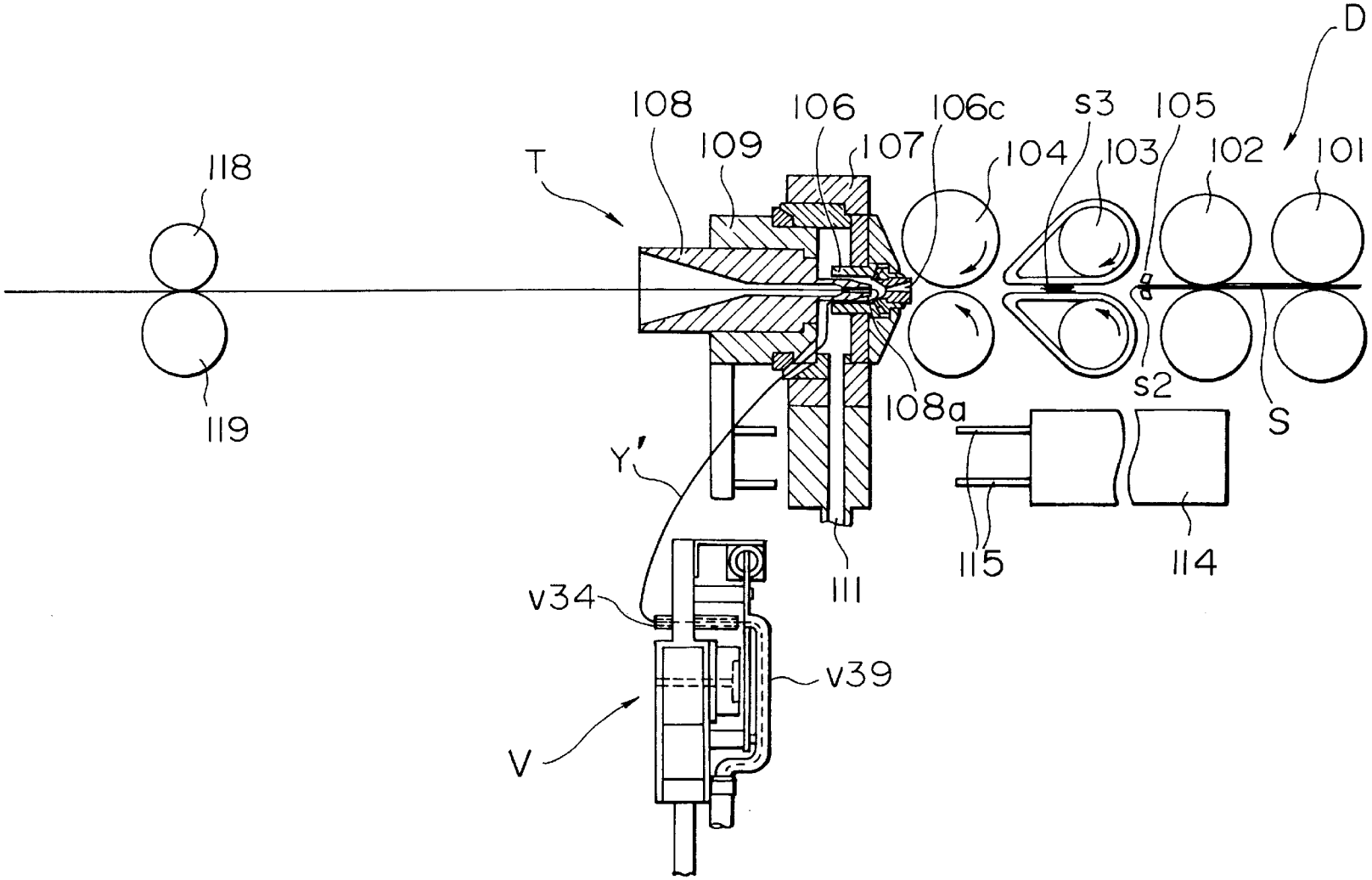
FIG. 11 is a side view of a spinning machine similar to that in FIG. 8 for describing the piecing process of the present invention.

Next, as shown in FIG. 11, the air sucker member V, which holds the leading yarn Y', is lowered, the piston rod 115 is retracted by operation of the cylinder 114 and the spindle support member 109 and nozzle block 107 are coupled. Even if the spindle support member 109 and nozzle block 107 couple, the leading yarn Y' is not trapped by the walls of the spindle support member 109 and nozzle block 107 as it enters the slits 112, 113.

After the insertion operation of the leading yarn Y' into the insertion hole 108*b* of the spindle 108 and before the start of the running of the leading yarn Y' by the nip roller 118 and delivery roller 119 and the start of the re-operation of the twist device T, the cut part s1 of the sliver S is cut and a cut tapered part s3 is formed between the normally rotating middle rollers 103 and once again stationary third rollers 102 by stoppage of the stationary back rollers 101 and third rollers 102 after they have been driven for a predetermined time period. As shown in FIG. 11, the driving time of rerotated back rollers 101 and third rollers 102 is adjusted so that the cut tapered part s3 is gripped by the middle roller 103 and/or front rollers 104. If the driving time of re-rotated back rollers 101 and third rollers 102 is long, trouble may occur where the cut tapered part s3 may reach the guide entrance 106*c* of the air spinning nozzle 106, become clogged in that guide entrance 106*c* and piecing may became impossible.

Thereafter, the rotation of the re-stopped back rollers 101 and third rollers 102 is restarted, and the cut tapered part s3 and the sliver S of which the short tapered cut part s2 is positioned between the third rollers 102 and middle rollers 103 are moved.

Furthermore, immediately after the driving of the back rollers 101 and third rollers 102, the nip roller 118 is contacted with the delivery roller 119 and the leading yarn Y' is run by clamping by the nip roller 118 and delivery roller 119. The twist device T is reoperated, in short, air is blown from the air blowing holes 106*b*.

Thus, firstly, the cut tapered part s3 is guided to the guide entrance 106*c* of the air spinning nozzle 106 and the fibers comprising the cut tapered part s3 are entangled with the leading yarn Y' which has started running in the vicinity of the tip 108*a* of the spindle 108. After the fibers comprising the cut tapered part s3 are entangled with the leading yarn Y', which has started running, as there are no fibers entangled in the leading yarn Y' until the fibers comprising the sliver S having the short tapered cut part s2 (described later) entangle with the leading yarn Y', there is only the leading yarm Y' and thereafter piecing is carried out by the fibers comprising the sliver S having the short tapered cut part s2 entangling with the leading yarn Y'.

Figure 16A:
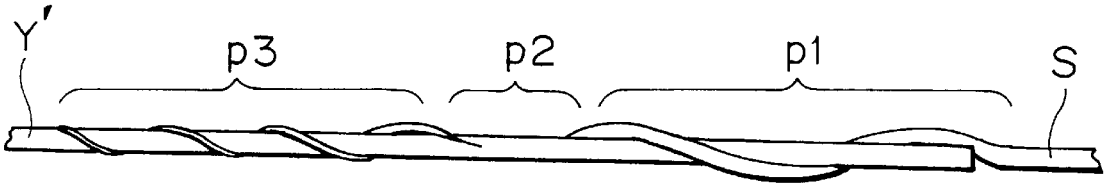
FIGS. 16A and 16B are plan views of the joint formed by the present invention.

Accordingly, as shown in FIG. 16A, a joint is formed where a piecing part p1 formed by the fibers comprising the sliver S having a short tapered cut part s2 entangled in the leading yarn Y', a part p2 of only the leading yarn Y', and a part p3 formed by the entangling of the fibers comprising the cut tapered part s3 entangled in the leading yarn Y' and separated from the piecing part p1 exist. As the part p3 separated from the aforementioned piecing part p1 is only wrapped around the leading yarn Y', it may be blown off and removed before being wound on the winding package or may be removed from the leading yarn Y' as a result of the blown air. Naturally, it is also possible for it to be left attached to the leading yarn Y'.

Incidentally, when piecing is performed, in order to more reliably attach the fibers comprising the sliver S to the running leading yarn Y' gripped by the nip roller 118 and delivery roller 119, it is preferable to cause hairiness by opening the leading yarn Y' inserted in the spindle 108. In particular, the separated part p3 is made to be easily removed without opening of leading yarn Y' positioned at the part p3 separated from the aforementioned piecing part p1 and furthermore, the fibers comprising the sliver S having the short tapered cut part s2 are entwined with the fuzzy fibers of the leading yarn Y' by making the leading yarn Y', positioned in the piecing part p1 fuzzy. Thus piecing may be carried out more reliably and a stronger joint may be formed. Accordingly, it is preferable for the tip of the leading yarn Y' inserted in the spindle 108 to be opened for a predetermined length.

Next, the air sucker member V that carries out suction and opening of the leading yarn Y' will be described using FIGS. 12 and 13.

Reference v1 is a frame of the head part V' of the air sucker member V. A hollow cylinder v2 is mounted on the frame v1. O-rings v6, v7, v8 are respectively inserted in circular grooves v3, v4, v5 arranged in the outer periphery of the cylinder v2. Reference v9 is a cylindrical cover of the cylinder v2. A hole v10 are arranged in the cylindrical cover v9. An 0-ring v13 is inserted between the groove v11 arranged in the inner periphery of the cylinder v2 and the small diameter part v12 arranged in the outer periphery of the cylindrical cover v9. Reference v14 is a slide nozzle positioned inside the hollow cylinder v2 and holes v16 are arranged in the cylindrical side wall v15 of the slide nozzle v14.

Reference v17 and v18 are ring members projecting from the cylindrical side wall v15 at right angles to the cylindrical side wall v15 and is positioned in the vicinity of the inner wall of the cylinder v2. A member having a suitable friction coefficient (not shown in the drawings) is inserted in the space between the ring members v17, v18 and the cylinder v2. The slide nozzle v14 is comprised so that it does not easily move by the tilting etc. of the air sucker member V.

It should be noted that this space may be arranged according to necessity in the cylinder cover v9 as well and a member having a suitable friction coefficient may be inserted as shown by v19. The outer wall of the slide nozzle v14 is comprised of a conical outer wall v20 continuous with the cylindrical wall v15 and a cylindrical wall v21 smaller in diameter than the cylindrical wall v15. The small diameter cylindrical wall v21 is inserted in the hole v10 so that it does not touch the inner wall of the hole v10 of the cylindrical cover v9.

Reference v22 is a cone shaped inner nozzle arranged with yarn passage hole v23 positioned in the slide nozzle v14. An appropriate number of fins v24 parallel with the axial line of the inner nozzle v22 are arranged in the outer wall of the inner nozzle v22. Reference v25 is a cylindrical cover mounted on the slide nozzle v14. A hole v25' are arranged in the cylindrical cover v25. An 0-ring v27 is inserted between the groove v26 arranged between the inner periphery of the slide nozzle v14 and the small diameter part v25" arranged in the outer periphery of the cylindrical cover v25.

Reference v28 and v29 are air supply pipes mounted on the frame v1 opposite two holes v30, v31 arranged at a predetermined spacing in the cylinder v2. The air supply pipe v28 and hole v30 arranged in the cylinder v2 are arranged opposite the space v33 formed by the ring member v18 and edge v32 of the cylinder v2.

Reference v34 is an opening pipe positioned on a frame v35 connected to the frame v1. Holes v36 are arranged in the opening pipe v34 at an angle. Reference v37 is a hollow cylinder fitted between the opening pipe v34 and the frame v35 and having holes v37" in the outer periphery connectable to the holes v36 arranged in a concave part v37' and opening pipe v34. Reference v38 is an air supply pipe.

It should be noted that an arrangement is preferable whereby holes v37" connectable to the holes v36 arranged in opening pipe v34 are arranged in another place separated by 90 degrees and by the rotation of the opening pipe v34 by 90 degrees, the rotation direction of the rotating air current generated inside the opening pipe v34 is switched.

Figure 12:
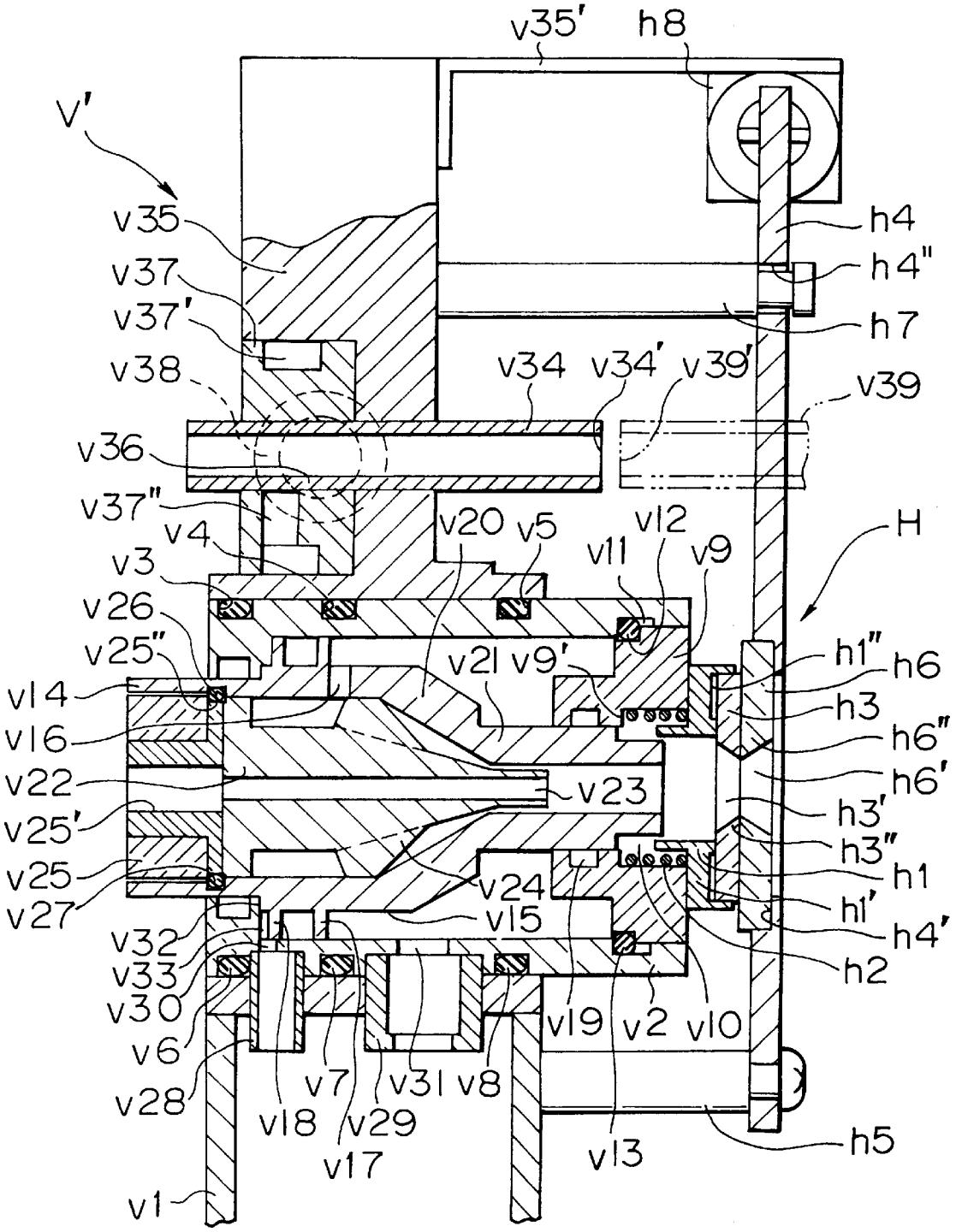
FIG. 12 is a vertical section view of the head part of the air sucker member used in the piecing method of the present invention.
Figure 13:
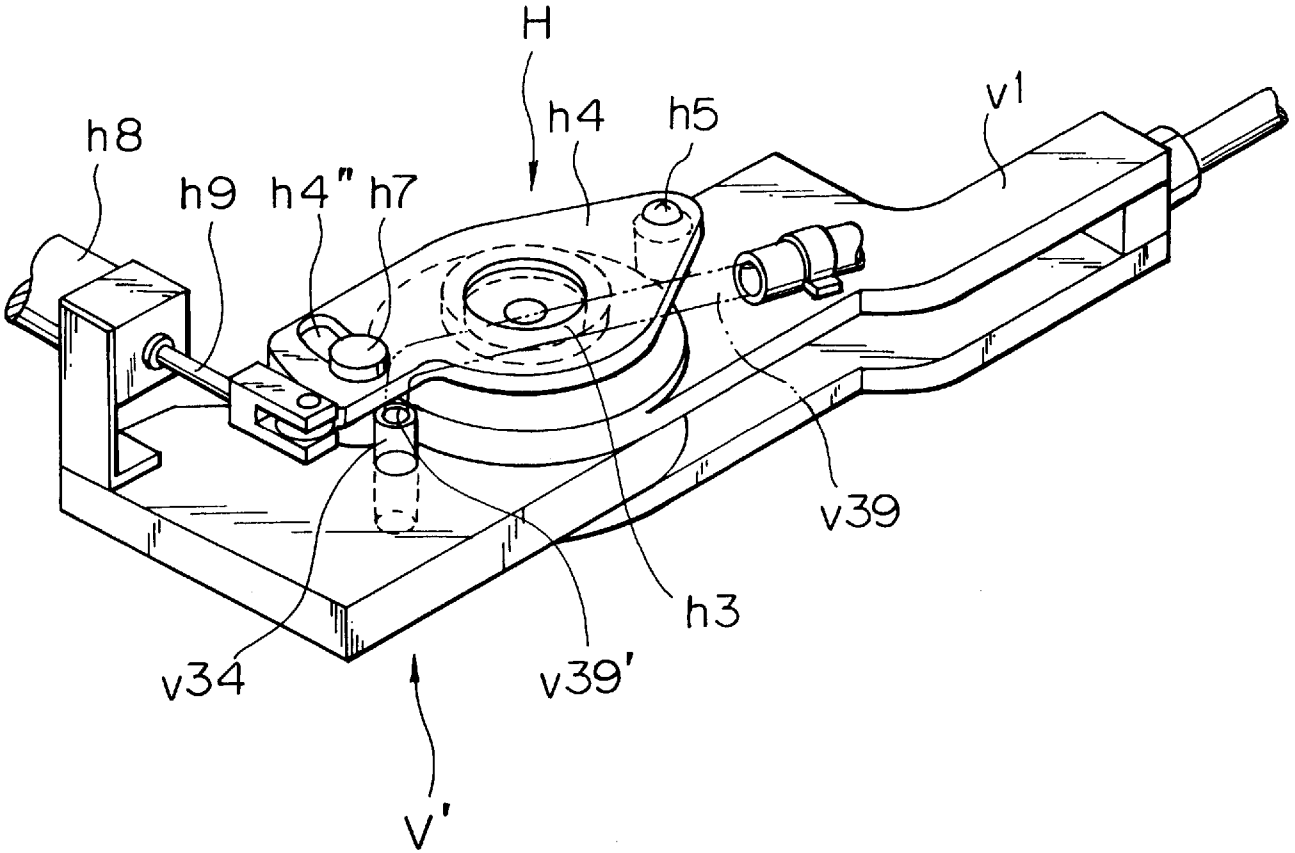
FIG. 13 is a perspective view of the head part of the air sucker member used in the piecing method of the present invention.
Figure 14A:
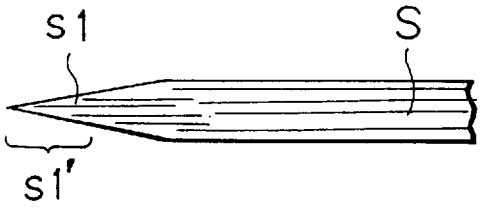
FIGS. 14A and 14B are plan views of the cut part of the sliver.
Figure 14B:
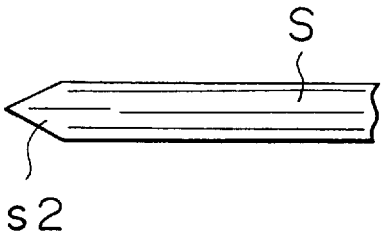
Figure 15:
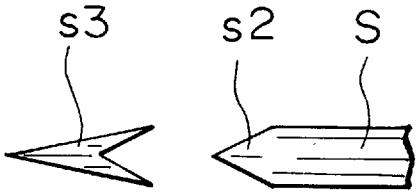
FIG. 15 is a plan view of re-cut sliver.

The slide nozzle v14 of the head V' having the above described structure is stored completely inside the cylinder v2 but when it is positioned near the tip 108*a* of the spindle 108 positioned on the spindle support member 109 where the slide nozzle v14 of the head V' is separated from the nozzle block 107, if compressed air is supplied to the air supply pipe v29, compressed air is delivered into the space between the slide nozzle v14 and cylinder v2, compressed air pressurizes the ring member v17 projecting from the cylindrical wall v15 of the slide nozzle v14 and, as the slide nozzle v14 moves to the left as seen from FIG. 12, the cylinder cover v25 mounted on the slide nozzle v14 projects from the cylinder v2 and the tip 108*a* of the spindle 108 fits with the hole v25' of the cylindrical cover v25.

After insertion of the leading yarn Y' in the insertion hole 108*b* of the spindle 108, in order to store the cylindrical cover v25 projecting from the cylinder v2 inside the cylinder v2 once again, compressed air is supplied to the air supply pipe v28 after the supply of compressed air to the air supply pipe v29 has been stopped. Thus, the compressed air enters the space formed by the ring member v18 projecting from the cylindrical wall v15 of the slide nozzle v14 and the edge v32 of the cylinder v2, the slide nozzle v14, on which the cylindrical cover v25 is mounted, is moved to the right, as seen from FIG. 12, and the cylindrical cover v25 projecting from the cylinder v2 is stored inside the cylinder v2 once again.

The compressed air supplied from the air supply pipe v29 makes the cylindrical cover v25 project from the cylinder v2 and enters the space formed by the slide nozzle v14 and the inner nozzle v22 from the holes v16 arranged in the cylindrical wall v15 of the slide nozzle v14. In order to expel it from the hole v10 arranged in the cylindrical cover v9, a suction air current is generated in the yarn passage hole v23 of the inner nozzle v22.

It should be noted that the fins v24 arranged on the outer periphery of the inner nozzle v22 are to prevent the air flowing in the space formed by the slide nozzle v14 and inner nozzle v22 from becoming a rotating air current.

Reference v39 is a suction pipe positioned near the ejection hole v34' of the opening pipe v34 and suction pipe v39 is mounted on the frame v1 of the head V'. The suction pipe v39 is connected to the air suction source (not shown in the drawings) and is for holding the leading yarn Y' inserted into the opening pipe v34 and of which the tip has been opened.

Next, a cutter member H positioned in the hole v10 arranged in the cylindrical cover v9 positioned in the suction air ejection side of the head V' will be described.

Reference is a roughly cylindrical fixed blade receiving member inserted in the hole v10 arranged in the cylindrical cover s9. A compressed spring h2 which applies a force in a direction pushing the fixed blade receiving member h1 from the cylindrical cover v9 is positioned between a flange h1' of the fixed blade receiving member h1 and a step part v9' arranged on the inner wall of the cylindrical cover v9. Reference h3 is a donut shaped fixed blade mounted on the concave part h1" arranged on the flange h1' of the fixed blade receiving member h1 and a blade is formed on the edge h3" of the hole h3' arranged in the center of the fixed blade h3.

Reference A is a movable blade receiving member of which one side is attached to the support column h5 projecting from the frame v1 of the head V'. A movable blade h6 is mounted on the concave part h4' arranged on the movable blade receiving member h4 so that it contacts with the fixed blade h3. Similar to the aforementioned fixed blade h3, holes h6' positioned concentric with the holes h3' of the fixed blade h3 are arranged in the movable blade h6 and a blade is formed by the edge h6" of the holes h6' arranged on the movable blade h6. Reference h7 is a support column standing from the frame v35 and the tip of the column h7 fits with half-moon shaped guide holes h4" arranged in the movable blade receiving member h4. Furthermore, a piston rod h9 of a cylinder h8 suitable positioned on the frame v35 via a frame v35' is attached to the free end of the movable blade receiving member h4.

Accordingly, the leading yarn Y' inserted through the hole h3' of the fixed blade h3 and the hole h6' arranged in the movable blade h6 may be cut by the movement of the cylinder h8 and the rotation around the column h5 of the movable blade receiving member h4 due to the piston rod h9 being freely retractable. Depending on the aforementioned cutter member H, the leading yarn Y' may be cut while being sucked, in short, while having the effects of the suction air current exerted upon it. Thus the leading yarn Y' may be reliably cut without becoming free as a result of this scissor type cutter and, moreover, cutting of a uniform length is possible.

Next, the actual actions of the air sucker member V during piecing operation will be described using FIGS. 9 to 13.

Figure 9:
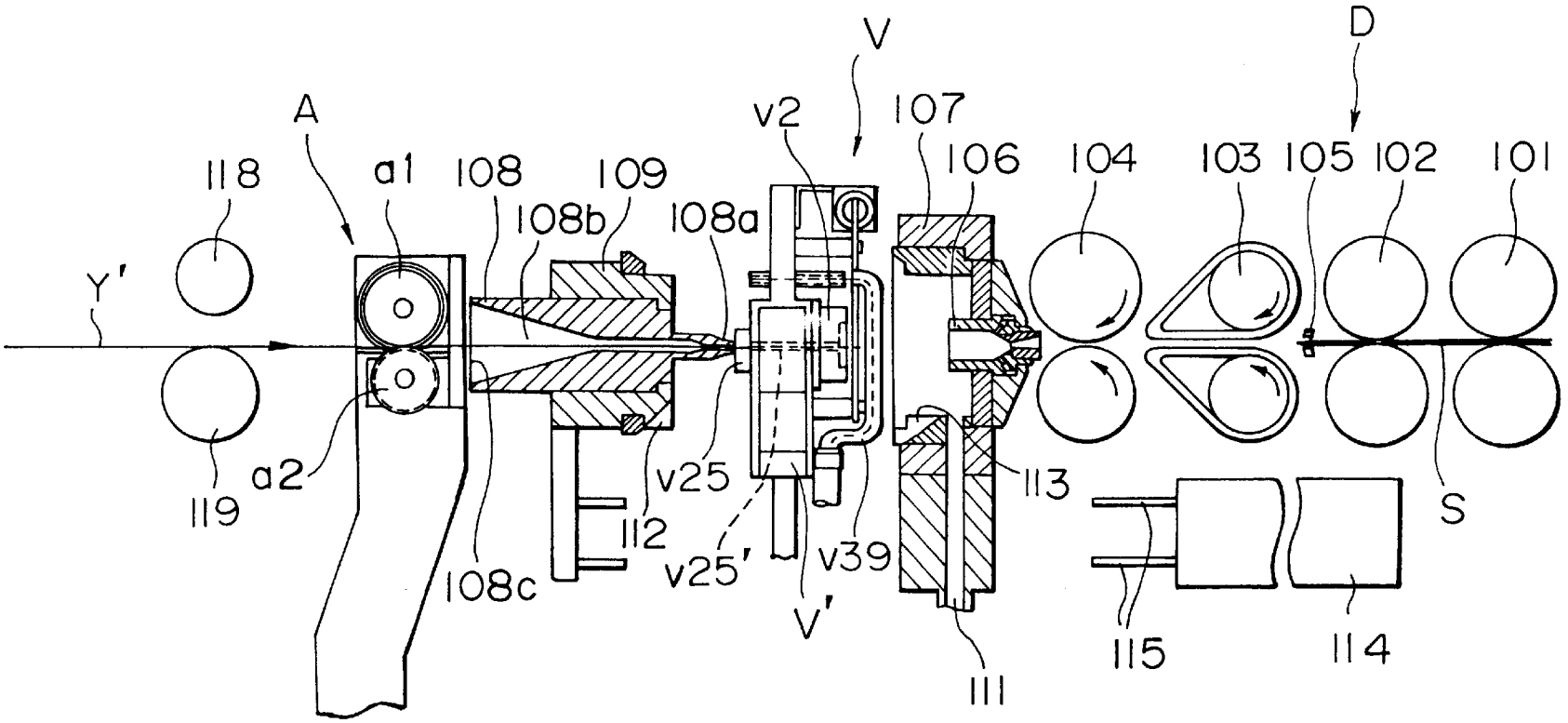
FIG. 9 is a side view of a spinning machine similar to that in FIG. 8 for describing the piecing process of the present invention.

As described above, when a yarn breakage occurs, the spindle support member 109 is separated from the nozzle block 107 by the operation of the cylinder 114. The transfer arm A which grips the tip of the leading yarn Y' by the pair of drive rollers a1, a2 is positioned near the yarn exit hole 108*c* of the spindle 108. The air sucker member V is positioned between the spindle support member 109 and nozzle block 107 such that the hole v25' of the cylindrical cover v25 stored in the cylinder v2 is positioned near the tip 108*a* of the spindle 108, as shown in FIG. 9.

Next, when compressed air is supplied to the air supply pipe v29, compressed air is drawn into the space formed between the slide nozzle v14 and cylinder v2, the compressed air pressurizes the ring member v17 projecting from the cylindrical outer wall v15 of the slide nozzle v14 and, as the slide nozzle v14 is moved to the left as seen from FIG. 12, the cylindrical cover v25 mounted on the slide nozzle v14 projects from the cylinder v2 and the tip 108*a* of the spindle 108 fits in the hole v25' of the cylindrical cover v25.

Furthermore, when compressed air is supplied to the air supply pipe v29, as a suction air current is generated in the yarn passage hole v23 of the internal nozzle v22, the leading yarn Y' gripped in the drive rollers a1, a2 is delivered by rotation of the drive rollers a1, a2 of the transfer arm member A. Accordingly, the leading yarn Y' is inserted in the insertion hole 108*b* of the spindle 108 by the suction air current generated in the yarn passage hole v23 of the internal nozzle v22. After insertion of the leading yarn Y' in the insertion hole 108*b* of the spindle 108, delivery of the leading yarn Y' is stopped by the stoppage of the rotation of the drive rollers a1, a2 of the transfer arm member A.

Next, the cylinder h8 is operated and the movable blade receiving member h4 rotated by advancement of the piston rod h9 and the leading yarn Y' flying from the yarn passage hole v23 is cut by the fixed blade h3 and movable blade h6.

Next, after stoppage of the supply of compressed air to the air supply pipe v29, compressed air is supplied to the air supply pipe v28. Thus compressed air enters the space formed by the ring member v18 projecting from the cylindrical wall v15 of the slide nozzle v14 and the edge v32 of the cylinder v2. The slide nozzle v14 on which is mounted the cylindrical cover v25 is moved to the right as seen from FIG. 12 and the cylindrical cover v25 projecting from the hollow cylinder v2 is once again stored in the cylinder v2.

Figure 10:
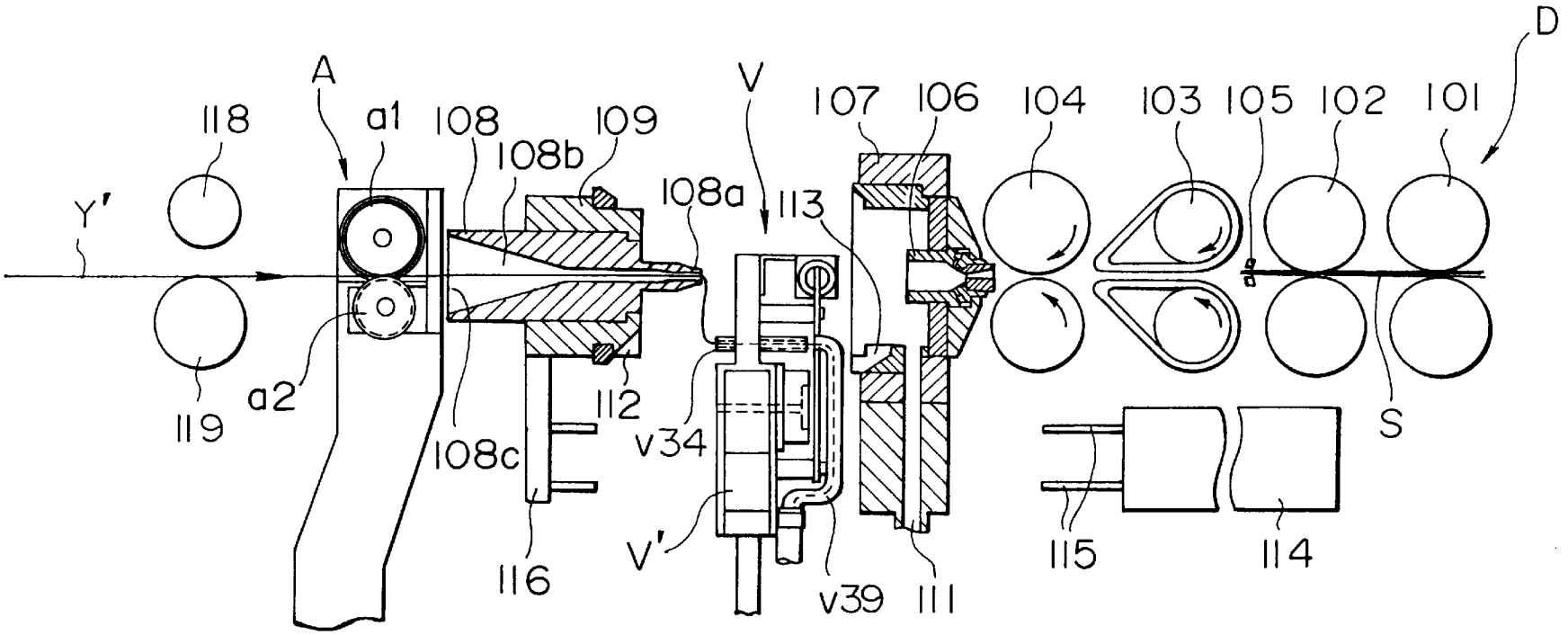
FIG. 10 is a side view of a spinning machine similar to that in FIG. 8 for describing the piecing process of the present invention.

Furthermore, the air sucker member V is lowered until the opening pipe v34 of the head V' of the air sucker member V is positioned below the spindle 108 as shown in FIG. 10. The tip of the leading yarn Y' is sucked into the opening pipe v34 and the tip of the leading yarn Y' is opened by the generation of a rotating air current in the direction of the nozzle block 107 being opposite the twist direction of the leading yarn Y'. Thus fluff is generated on the leading yarn Y'.

The supply of air from the air supply pipe v38 to the opening pipe v34 is stopped at the point when the opening operation of the tip of the leading yarn Y' has finished and the opening operation by the opening pipe v34 stops.

Next, a predetermined length of leading yarn Y' forming the joint is delivered by the starting of delivery of the leading yarn Y' by the restarting of the rotation of the drive rollers a1, a2 of the transfer arm member A. The delivered leading yarn Y' is sucked into the suction pipe v39 positioned near the leading yarn Y' ejection hole v34' of the opening pipe v34.

At the point when the predetermined length of leading yarn Y' which will form the joint is sucked into the suction pipe v39, the delivery of the leading yarn Y' is stopped by stoppage of rotation of the drive rollers a1, a2 of the transfer arm member A and the transfer arm member A is returned to the predetermined standby position.

It should be noted that as the structure of the transfer arm member A has been disclosed in the Japanese Patent Application Hei 4-90242, the details have been ommitted here. If the system is such that the leading yarn Y' may be gripped and run, any system is suitable.

Thereafter, as shown in FIG. 11, the air sucker member V, which holds the leading yarn Y' by the suction pipe v39 and of which the tip has been opened, is lowered, the piston rod 115 retracted by operation of the cylinder 114 and the spindle support member 109 and nozzle block 107 coupled.

Next, due to driving of the stationary back roller 101 and third roller 102 for a predetermined time period and then stoppage, the cut part s1 of the sliver S is cut between the normally rotating middle roller 103 and re-stopped third rollers 102 and a cut tapered part s3 formed. As shown in FIG. 11, the driving time of the re-rotated back rollers 101 and third rollers 102 is adjusted so that the cut tapered part s3 is held in the middle rollers 103 and/or front rollers 104.

Thereafter, the rotation of the re-stopped back rollers 101 and third rollers 102 is restarted and the cut tapered part s3 and sliver S, of which the short tapered cut part s2 is positioned between the third rollers 102 and middle rollers 103, are moved together. Further, immediately after the driving of the back rollers 101 and third rollers 102, the nip roller 118 is connected with the delivery roller 119 and the leading yarn Y' run by being gripped by the nip roller 118 and delivery roller 119 and piecing is carried out by re-operation of the twist device T.

The piecing operation firstly involves the cut tapered part s3 being guided into the guide entrance 106*c* of the air spinning nozzle 106 and the fibers comprising the cut tapered part s3 being entangled in a screw shape with the opened leading yarn Y' which has started running near the tip 108*a* of the spindle 108. After entangling the fibers comprising the cut tapered part s3 with the leading yarn Y' which has started running, as there are no fibers entangled in the leading yarn Y' until the fibers comprising the sliver S having a continuous short tapered cut part s2 are spirally entangled in the opened leading yarn Y', there is only the leading yarn Y' and thereafter, piecing is carried out by spirally entangling the fibers comprising the sliver S having a continuous short tapered cut part s2 in the leading yarn Y'.

In this way, the tip of the leading yarn Y' which forms the piecing part and where entangling of the fibers comprising the sliver S having a continuous short tapered cut part s2 and the leading yarn Y', are entangled, are opened in a fuzzy state thus the fibers comprising the sliver S and the fibers of the fuzzy leading yarn Y' is entwined and piecing may be more reliably carried out. Furthermore, a stronger joint is formed.

Figure 16B:
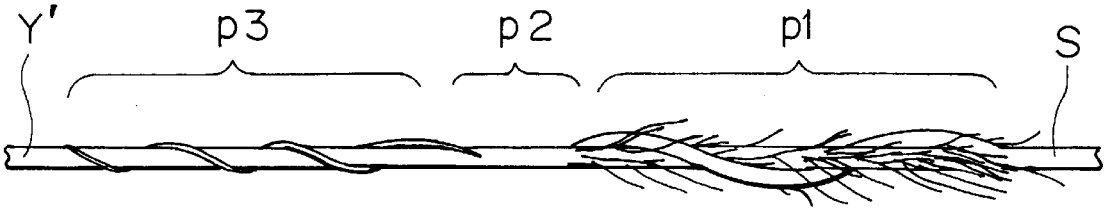

The joint formed using the leading yarn Y' where the tip has been opened is shown in FIG. 16B. A joint is formed in the leading yarn Y' from the piecing part p1 formed by the the fibers comprising the sliver S having a continuous short tapered cut part s2 entangling with the opened leading yarn Y', the part p2 of only the leading yarn Y' and, the part p3 separated from the aforementioned piecing part p1 and formed by the fibers comprising the cut tapered part s3 entangling with the leading yarn Y' which has not been opened. The leading yarn Y' of the part p2 which is only the leading yarn Y' may be either opened or not opened.

As the joint formed by the present embodiment is formed from the piecing part p1 formed by the fibers comprising the sliver S having a continuous short tapered cut part s2 entangling with the opened leading yarn Y', the part p2 of only the leading yarn Y' and, the part p3 separated from the aforementioned piecing part p1 and formed by the fibers comprising the cut tapered part s3 entangling with the leading yarn Y' which has not been opened, the removal of the part p3 formed by the fibers entangling with the leading yarn Y' which has not been opened may be easily achieved. Further, as the piecing part p1 is comprised of the short tapered cut part s2 having a high fiber density, there is no deformation of a bad joint by thinning or decreases in joint strength.

As the present embodiment has the above described structure, it demonstrated the following advantages:

As piecing may be carried out without the removal of the cut tapered part, the piecing time may be shortened and a more simplified device may be realised.

As the tip of the leading yarn is opened, the piecing success rate is increased and the strength of the joint may be increased.

As the part where the fibers comprising the cut tapered part are entangled is separated from the piecing part, the removal of the part where the fibers comprising the cut tapered part are entangled from the joint is easily achieved.

Figure 17:
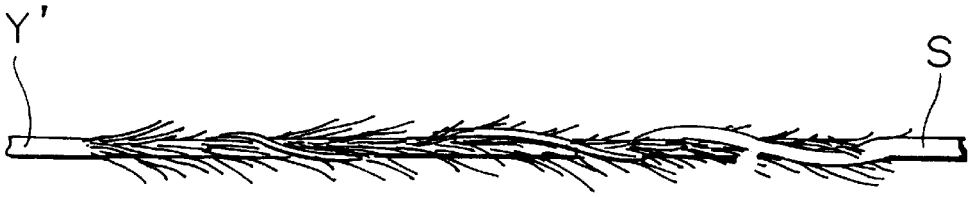
FIG. 17 is a plan view of the another joint part formed by the present invention.

It should be noted that reliable piecing may be carried out by the entangling of the fuzzy fibers of the surface of the leading yarn Y' where the leading yarn Y', has been made fuzzy by opening the leading yarn Y' as shown in FIG. 17, by the aforementioned opening tube v34 along the entire length of the leading yarn Y' from the tip where entangling of the fibers comprising the tapered tip of the sliver S entangle with the leading yarn Y' to the tip of the leading yarn Y' held in the suction tube v39 via the opening tube v34 of the air sucker member V, and the fibers comprising the tapered tip of the sliver S. Furthermore, by the entangling of the fuzzy fibers of the surface of the leading yarn Y' with the fibers comprising the sliver S, as a joint may be formed that looks like a single yarn, a joint with superior shape may be formed.

By opening approximately the whole leading yarn which will form the joint, a more stable, more reliable piecing may be performed.

By cutting the leading yarn inserted in the spindle of the twist device, the opened part of the leading yarn may be optionally controlled by specifying the position of the leading yarn.

I claim:

1. A piecing method for piecing yarn which has been severed in a spinning machine having means for winding yarn produced by said spinning machine, a twist device including means for imparting a twist to fibers delivered to said twist device containing a spinning chamber and a spindle for delivering yarn produced by said twist device, and a draft device including continuously rotating draft rollers and selectively rotatable draft rollers for delivering sliver to said twist device, said piecing method comprising the steps of:

stopping the rotation of said selectively rotatable draft rollers to produce sliver having a length of tapered tip;

withdrawing yarn from said yarn winding means of a predetermined length sufficient to entangle substantially the entire tapered tip of said silver and delivering it to a position within the spinning chamber of said twist device;

delivering said silver with the tapered tip to said spinning chamber of said twist device whereby twisting forces operate to entangle and thereby piece fibers of said tapered tip of said silver with said yarn from said winding means; and operating said selectively rotatable draft rollers and said winding means to reestablish operation of said spinning machine.

2. A piecing method as recited in claim 1, wherein in the delivery step the fibers of the tapered tip of the sliver contact the yarn while the yarn is stationary, and including the step of thereafter starting running of the yarn on said winding means.

3. A piecing method as recited in claim 1, including the steps of contacting the fibers of the tapered tip of the sliver with the yarn as the winding means operates to run said yarn.

4. A piecing method as recited in claim 1, including the steps prior to the operating step, of untwisting the tip of the yarn after inserting it into the spindle of the twist device.

5. A piecing method as recited in claim 4 including the steps prior to the operating step, of holding said yarn stationary by suction, and thereafter forming a joint by entangling the untwisted yarn with the fibers of the tapered tip of the sliver.

6. A piecing method as recited in claim 5, wherein substantially all of the yarn forming the joint part is untwisted.

7. A piecing method as recited in claim 6, including the step prior to the operating step, of cutting the yarn inserted in the spindle of the twist device.

* * * * *